United States Patent [19]

Brown

[11] 4,057,433

[45] Nov. 8, 1977

[54] OXYFLUORIDE-TYPE MOLD FOR CASTING MOLTEN REACTIVE AND REFRACTORY METALS

[75] Inventor: Robert A. Brown, Scio, Oreg.

[73] Assignee: Rem Metals Corporation, Albany, Oreg.

[21] Appl. No.: 601,611

[22] Filed: Aug. 1, 1975

Related U.S. Application Data

[63] Continuation-in-part of Ser. No. 448,254, March 5, 1974, abandoned, which is a continuation of Ser. No. 332,608, Feb. 15, 1973, abandoned, which is a continuation of Ser. No. 174,662, Aug. 25, 1971, abandoned.

[51] Int. Cl.[2] ..... B28B 7/34

[52] U.S. Cl. ..... 106/38.3; 106/38.35; 106/38.9; 164/24; 164/26

[58] Field of Search ..... 106/38.22, 38.27, 38.3, 106/38.35, 38.9; 164/23, 24, 26, 34, 361

[56] References Cited

U.S. PATENT DOCUMENTS 3,537,949 11/1970 Brown et al. ..... 106/38.27

*Primary Examiner*—Lorenzo B. Hayes
*Attorney, Agent, or Firm*—Eugene D. Farley

[57] ABSTRACT

A mold for casting molten reactive and refractory metals has a facing portion comprising finely divided particles of the oxyfluorides of the metals of Group III*a*, including the lanthanide and actinide series, of the Periodic Chart (after Mendeleeff) and a back-up portion comprising finely divided particles of shell mold back-up material. The oxyfluroide content of the facing portion is essentially inert to titanium and other reactive and refractory molten metals and hence minimizes contamination by mold degradation products of metal objects cast in the mold.

10 Claims, 1 Drawing Figure

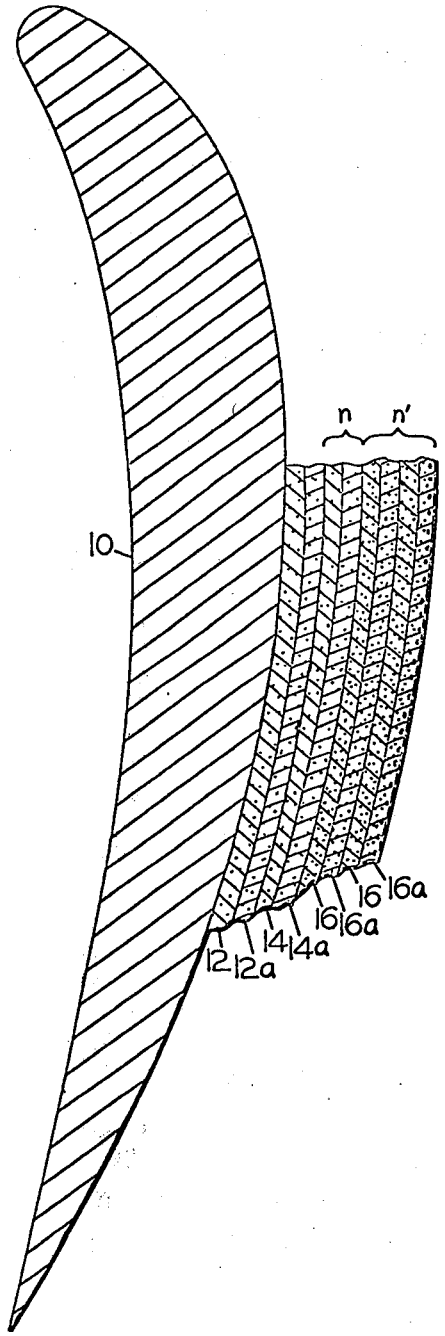
n
n'
10
16
16a
16
16a
14
14a
12
12a

OXYFLUORIDE-TYPE MOLD FOR CASTING MOLTEN REACTIVE AND REFRACTORY METALS

This is a continuation-in-part of application Ser. No. 448,245, filed Mar. 5, 1974, now abandoned; which, in turn, is a continuation of application Ser. No. 332,608, filed Feb. 15, 1973, now abandoned; which, in turn, is a continuation of application Ser. No. 174,662 filed Aug. 25, 1971, now abandoned.

This invention relates to molds, particularly investment shell molds, for use in casting molten titanium, zirconium, columbium, tantalum and other molten reactive and refractory metals.

Brown et al U.S. Pat. No. 3,422,880 discloses a method of making investment shell molds in which a disposable pattern is dip coated in a liquid suspension of columbium, molybdenum, tantalum, or tungsten powder mold material and a metal oxide binder. The dip coated pattern is stuccoed with at least one of the named metal powders, after which it is dried.

Further dip coats and stucco coats of predetermined composition are applied in number sufficient to build up a finished mold of the desired composition and strength. The pattern is removed and the mold fired. It then is ready to receive molten titanium or other reactive and refractory casting metal.

Shell molds made by the foregoing method are highly useful and have the important advantage of producing high integrity castings of precise dimensions. However, in the case of certain casting metals and under certain conditions of operation, the highly reactive molten metal poured into the mold may not fill very thin recesses in the mold and the resultant casting may contain misrun and cold shut in addition to no-fill defects. Also, the metal cast into a metal lined mold may extract heat too rapidly and prevent adequate directional solidification. Because of this, castings produced in molds possessing high thermal conductivity will usually contain more internal shrinkage porosity than castings produced in molds which have lower thermal conductivity and have lower rates of heat transfer through the mold interface when other factors, such as mold temperature and metal temperature, are held constant.

It is the object of the present invention to provide a mold which is resistant to the degrading action of reactive and refractory molten metals cast therein and which accordingly may be employed to advantage in the manufacture of cast products of high quality.

In accordance with the present invention, advantage is taken of the discovery that the oxyfluorides of certain metals are essentially inert toward the reactive and refractory metals and hence may be employed in the manufacture of molds, particularly investment shell molds, possessing superior properties.

The hereindescribed molds are useful in the high integrity precision casting of the reactive and refractory metals including zirconium, hafnium, molybdenum, columbium, tantalum and titanium.

The molds of the invention may be prepared by various methods, but in particular by known techniques of making investment shell molds. In accordance with these methods, use is made of a pattern constituted of various disposable materials such as waxes and plastics which readily may be removed from the mold after its formation. Each pattern is made by injecting the selected pattern material in fluid condition into a die, permitting it to solidify, removing it from the die and, if desired, joining the resulting pattern to a central sprue to form a pattern cluster.

As indicated in the single figure of the drawings, a pattern, indicated figuratively and generally at 10, is subjected to an investment cycle which includes the steps of dipping the pattern into an agitated slurry of the mold material, draining, stuccoing (optionally) while still wet with particulate mold material in a fluidized bed or by sprinkling, and drying to a solvent content of preferably less then 20% by volume. The dipping, draining, stuccoing and drying sequence is repeated the desired number of times to produce a laminated investment shell mold of the desired thickness and strength.

The coats of mold-forming material thus applied build up a mold which comprises in general a "facing portion" and a "backup portion".

The facing portion of the mold includes the coats which come, or may come, in direct contact with the molten casting metal, or with the vapor produced therefrom. It comprises a "face coat" and "adjacent face coats".

The face coat is the first coat applied, **12, 12*a***, and constitutes the inner face of the mold. It is in direct contact with the molten metals subsequently cast therein and provides the mold interface. A single dip coat with or without a stucco coat normally comprises the face coat.

The adjacent face coats **14, 14*a*** comprise alternate dip coats and stucco coats applied in sequence on top of the face coat. There may be one or any desired number "*n*" of such coats.

The backup portion of the mold is comprised of those coats which serve primarily a structural function. They normally do not come in direct contact with the molten casting metal, or with the vapor produced therefrom. It is composed of backup coats **16, 16*a*** each comprised of alternate dip coats and optional stucco coats applied in sufficient number "*n*" to add the required thickness and strength to the mold. There normally are several backup coats applied to the pattern in building up a mold.

The thickness of the facing portion of the mold is variable depending upon such factors as the mold components, the metal to be cast, and the conditions of casting. However, stated in absolute units, the mold in general should have a face portion not over 10 mm. preferably not over 5 mm. in thickness.

After completion of the investment procedure, the disposable pattern is removed from the mold shell by a method such as melting or solvent treatment. The mold is dried in an oven to remove low temperature volatiles. Next, it is cured by firing at a temperature sufficiently elevated to remove high temperature volatiles and provide adequate bonding. If hydrogen-reducible binder inhibitors are employed, the molds should be fired in a hydrogen-containing atmosphere to effect reduction of the inhibitor compounds to metallic inhibitors.

In use of the mold, it is heated and filled with molten metal by gravity, pressure or centrifugal force. After cooling the mold is removed from the resultant casting. The casting is removed from the sprue and finished in the usual manner.

The present invention provides a mold which may be manufactured by the foregoing sequence and which is substantially non-reactive toward molten refractory and reactive metals subsequently cast therein. As indicated above, the mold basically comprises a facing portion comprising finely divided particles of the oxyfluorides of certain metals with a suitable binder therefor, and a backup portion comprising finely divided particles of shell mold back-up material and a binder therefor.

I have discovered, and it is the essence of the present invention, that the oxyfluorides of certain metals are unique in their suitability for use as primary constituents of investment shell molds. In the first place, the oxyfluorides of these metals are almost entirely inert toward titanium and other reactive and refractory metals in the molten condition. Accordingly, they will not react with, nor contaminate, the molten casting metals with which they are in contact at the mold interface.

In the second place, the oxyfluorides of these metals have extremely high melting points, i.e. melting points of above 2000° K. Accordingly they will not flow and destroy the molding surface, even at the extremely high temperatures of casting the metals in question. In this respect they are distinguishable from the companion compounds, the fluorides of the same metals since the melting points of the oxyfluorides are from 400°to 1000° K. higher than the melting points of the corresponding metal fluorides.

In the third place, the oxyfluorides of these metals have surprisingly low vapor pressures. This is important since it assures that during casting the oxyfluoride mold materials will not vaporize, forming bubbles and rough surface properties in the cast metal after solidification.

More specifically, the vapor pressures of the oxyfluorides of these metals are 100 to 1000 times lower at equivalent temperatures than the vapor pressures of the fluorides of the same metals. For example, the vapor pressure of yttrium fluoride at 1400° K. is $1.0 \times 10^{-3}$ to $3.0 \times 10^{-3}$ mm. mercury, while the vapor pressure of stoichiometric yttrium oxyfluoride is approximately $3.7 \times 10^{-6}$ mm. mercury at the same temperature. Similarly the vapor pressure of samarium oxyfluoride is approximately $4.2 \times 10^{-6}$ mm. at 1400° K. On the other hand, the vapor pressure of the least volatile fluoride, calcium fluoride is approximately $3.0 \times 10^{-4}$ mm. mercury.

An important ancillary advantage flows from the uniquely high melting points and uniquely low vapor pressures of the metal oxyfluorides under consideration. Since they are more resistant to melting and vaporizing at the high temperature required for pouring the molten reactive and refractory metals, the heat sink components normally incorporated in the mold need not be included as mold constituents. This simplifies the formulation of the mold coatings and the construction of the mold.

The metals whose oxyfluorides are of use in the presently described molds broadly comprise the metals of Group III*a* and the lanthanide and actinide series of Group III*a* of the Mendeleevian Periodic Chart of the atoms as set forth on page 30 of "Advanced Inorganic Chemistry" by F.A. Cotton and G. Wilkinson; Interscience Publishers, 1962. To be suited for the present purpose the oxyfluorides of these metals must have free energies of formation at 1000° K. of at least 69 kilocalories per gram atom of contained oxygen and fluorine.

Preferred metal oxyfluorides for use in the facing portion of the hereindescribed molds comprise the oxyfluorides of cerium, neodymium, praseodymium, samarium, lanthanum, thorium, scandium, and yttrium.

These and other oxyfluoride compounds may be used singly or in admixture with each other in predetermined proportions as required to impart desired properties to the facing portion of the mold. They are employed in finely divided, graded condition having a particle size, for example, in the range of from below 400 mesh to 5 mesh, U.S. Sieve Series, i.e. having a particle size of from 0.1 to 4000 microns.

It is preferred to include also the metal oxide binders disclosed in the aforesaid patent of Brown et al U.S. Pat. No. 3,422,880. Such binders in general comprise certain refractory metal oxides or compounds pyrolyzable to such oxides. These are used in the liquid state, in dissolved condition, or suspended or dispersed in aqueous or other liquid media.

In general, those metal oxides are preferred as binders which are oxides of the group III and IV metals in the Mendeleevian periodic chart noted hereinabove; which have free energies of formation at 1000° K. greater than 69 kilocalories per gram atom of oxygen in the oxide; which melt, after pyrolyzation, at a temperature of more than 1000° K.; which bond upon pyrolyzation; and which provide a high temperature bond for the mold material particles.

Preferred binders of this class are the oxides and the compounds which form oxides upon pyrolysis, of zirconium, thorium, hafnium, yttrium and gadolinium. Compounds which form such oxides upon pyrolysis are the polymeric carboxylates such as diacetato zirconic acid (zirconium acetate); the basic oxyhalogenides; the metal-organic compounds, particularly the alkoxides; the alkoxide alcoholates; the oxide alkoxide alcoholates; the polymeric alkoxides; the oxide alkoxides; the hydrolyzed alkoxides; the halogenated alkoxides, and the hydrolyzed halogenated alkoxides of zirconium, thorium, hafnium, yttrium, and gadolinium. Upon pyrolysis, the foregoing are converted to metal oxide binders which normally mature and cure below the sintering temperature of the mold material components of the facing and adjacent facing systems, and thus normally ideally serve the purposes of the invention.

Other binders which may be employed comprise various phosphates such as magnesium phosphate and such conventional binders as calcium aluminate and sodium silicate. All of these binders, however, must meet the minimum free energy of formation requirement of at least 69 kilocalories per gram atom of contained oxygen at 1000° K. and the minimum melting point requirement of 1000° K. after pyrolyzation.

A primary beneficial property, for present purposes of the herein described metal oxyfluoride mold compounds is their low thermal conductivity. As a result, they are efficient thermal insulators which insure that continued fluidity of molten casting metals poured into the molds. The lower the heat flow through the mold interface, the greater the fluidity of the casting metal and the better the resultant directional solidification of the latter during the cooling process.

Most casting metals undergo volumetric contraction during solidification. If insufficient time is allowed for solidification shrink porosity may form in the casting. The low heat thermal conductivity of the herein described metal oxyfluorides insures that the casting metal will have time to flow into all of the mold recesses and to solidify with minimum formation of shrink holes.

If desirable or necessary in a given case, the presently described mold compositions may be modified by the inclusion of an inhibitor of the class described in the copending application of Robert A. Brown, Ser. No. 149,485, Filed June 3, 1971, now U.S. Pat. No. 3,743,003, for Making Investment Shell Molds Inhibited Against Reaction with Molten Reactive and Refractory Casting Metals.

Such an inhibitor has for its function inhibiting the deleterious reactions which may occur between some molten reactive and refractory metals cast in the mold with the various face coat mold materials and metal oxide binders employed in making the mold. As set forth in the patent application noted above, there may be employed as inhibitors certain compounds of molybdenum and tungsten, namely the oxides, acids, double salts, alkoxides, halogenated alkoxides halides and oxyhalides of these metals. When such an inhibitor-former is incorporated in the mold face coat and when a hydrogen environment is used in the mold curing furnace, the inhibitor is reduced in the furnace to metallic molybdenum or tungsten. This forms a coating of metal on the particles of mold material and binder. The coating acts as a physical barrier which retards attack on the mold materials and the binder by the molten casting metal. It also acts as a close proximity heat sink.

The foregoing and other selected mold face coating materials are intimately mixed with a suitable liquid vehicle in the preparation of a slurry into which the pattern is dipped. A suitable vehicle comprises water or various organic solvents, especially the lower aliphatic alcohols having fewer than 4 carbon atoms, i.e. methyl alcohol, ethyl alcohol and the propyl alcohols. Admixtures of water and other water soluble organic solvents also may be employed.

The liquid vehicle is employed in amount sufficient to impart the desired viscosity to the slurry. A suitable viscosity lies within the broad range of 50 to 750 centistokes at room temperature.

In the manufacture of the molds, suitable adjacent face coat and back-up coat slurries also are formulated. The herein described metal oxyfluorides may or may not be constituents of the adjacent face coat slurry, which may in general have compositions illustrated in U.S. Pat. No. 3,422,880 noted above. Low cost ceramic mold materials and refractory metal oxide binders are of particular usefulness in formulating the back-up coating slurries.

In the manufacture of the mold, the pattern first is treated with a suitable solvent as required to remove any die release agent which may be present on its surface. It then is immersed with agitation in the face dip coat slurry and rotated to insure complete coverage. After a dwell period of from5 to 60 seconds, it is withdrawn and, typically, drained for from 10 to 60 seconds. The wet pattern assembly then normally is stuccoed with finely divided material which may comprise the finely divided oxyfluorides of the herein described metals. In the alternative, it may comprise finely divided molybdenum or tungsten having a mesh size of about −60 to +150 (U.S. Sieve Series). Further, it may be stuccoed with an oxide of a metal such as zirconium, hafnium, thorium, yttrium, or gadolinium, or with a selected face coat mold material.

The dip coated and stuccoed pattern assembly then is air dried until the coat has a solvent content of below about 20% by volume. If desired, dip coat gelling or vacuum drying techniques also may be employed supplemental to, or in lieu of, air drying.

The dried assembly next is treated with superimposed alternating dip coats and stucco coats of predetermined composition and number until a mold of the desired size and strength has been fabricated. Thereafter, the mold is heated to fluidize and remove the disposable pattern which thus has been invested to form the mold. It next must be oven dried and cured.

The mold is oven dried in either air or a non-oxidizing atmosphere at from 500° K. to 650° K. for 4 to 8 hours. This removes most of the low temperature volatiles.

Where an inhibitor-former has been incorporated in the face coat slurry, the dry mold is placed in a furnace and treated with hydrogen gas for reduction of the inhibitor-former to metallic molybdenum, tungsten or rhenium. The treatment with hydrogen gas preferably is effectuated in a purging environment of the latter in order to sweep out of the vicinity the mold water vapor which usually is formed as a product of the action between the inhibitor-former and gaseous hydrogen. Such water vapor, if permitted to remain in contact with the mold, would react with the metal interface in an undesirable manner.

The hydrogen gas should be employed in an amount which is at least the stoichiometric amount required for reducing the inhibitor-former. This is desirable since, at least in the case of certain inhibitor-formers, a residue of the same left at the mold interface would cause the occurrence of undesirable side reactions between the mold and the casting metal poured therein.

The mold is heated in the hydrogen environment at a temperature and time sufficient to reduce substantially completely the inhibitor-forming compound. In the usual case, it requires heating the mold at a temperature of from 900° K. to 2500° K. for a time of from 2 to 4 hours. In order to prevent mold distortion or sagging, it is desirable that the final mold curing temperature be below the melting temperature of any of the mold materials which at this stage of the process still are present in the mold.

If desired, after treatment with hydrogen, the molds may be vacuum processed at high temperature in known manner.

Subjecting the molds to the action of hydrogen at high temperature serves various functions. If metallic oxide-forming binders have been employed, the heat drying converts such binders to metal oxide binders. It also removes essentially all of the remaining volatiles from the mold and provides the mold with a high temperature bond without destroying or distorting it.

Heat curing in the presence of hydrogen effects reduction of the inhibitor-former to metallic molybdenum, tungsten or rhenium. This forms a metallic barrier at the mold interface and effectively covers the particles of face coat mold material and oxide binder. It thus inhibits reaction between the mold constituents and the reactive and refractory molten metals subsequently cast therein.

The molds of the invention are illustrated further in the following examples, wherein amounts are given in percent by weight.

EXAMPLE I

| | Facing Slurry | 2 | 3 | 4 and Up |
|---|---|---|---|---|
| Diacetatozirconic Acid (22% $ZrO_2$ in water) | 46.2 | 46.2 | 0 | 0 |
| Calcined neodymium | | | | |

EXAMPLE I-continued

| | Facing Slurry | 2 | 3 | 4 and Up |
|---|---|---|---|---|
| Oxyfluoride (−325 mesh) | 53.8 | 53.8 | 0 | 0 |
| Zirconium Oxide (−325 mesh) | 0 | 0 | 77.0 | 0 |
| Hydrolyzed Tetraethylortho-silicate Solution (15% $SiO_2$ in Ethanol) | 0 | 0 | 23.0 | 25.0 |
| Aluminum Silicate (−325 mesh) | 0 | 0 | 0 | 50.0 |
| Aluminum Silicate (−20+50 mesh) | 0 | 0 | 0 | 25.0 |
| Stucco | Lanthanum Zirconate −50+100 | $ZrO_2$ −35+80 | $ZrO_2$ −35+80 | Aluminum Silicate −20+50 |

EXAMPLE II

| | Facing Slurry | 2 | 3 | 4 and Up |
|---|---|---|---|---|
| Diacetatozirconic Acid (22% $ZrO_2$ in water) | 13.7% | 13.7 | 0 | 0 |
| Water | 5.3% | 5.3 | 0 | 0 |
| Ammonium Metatungstate Inhibitor | 23.4% | 23.4 | 0 | 0 |
| Lanthanum Oxyfluoride (−325 mesh) | 57.6% | 57.6 | 0 | 0 |
| Zirconium Oxide (−325 mesh) | 0 | 0 | 77.0 | 0 |
| Hydrolyzed Tetraethylor-thosilicate Solution (15% $SiO_2$ in Ethanol) | 0 | 0 | 23.0 | 25.0 |
| Aluminum Silicate (−325 mesh) | 0 | 0 | 0 | 50.0 |
| Aluminum Silicate (−20+50 mesh) | 0 | 0 | 0 | 25.0 |
| Stucco | LaOF −80+150 | LaOF −35+80 | $ZrO_2$ −35+80 | Aluminum Silicate −20+50 |

EXAMPLE III

| | Facing Slurry | 2 | 3 | 4 and Up |
|---|---|---|---|---|
| Diacetatozirconic Acid (22% $ZrO_2$ in water) | 33.7 | 33.7 | 0 | 0 |
| Water | 3.2 | 3.2 | 0 | 0 |
| Thorium Oxyfluoride (−325 mesh) | 63.1 | 63.1 | 0 | 0 |
| Zirconium Oxide (−325 mesh) | 0 | 0 | 77.0 | 0 |
| Hydrolyzed Tetraethyl-orthosilicate Solution (15% $SiO_2$ in Ethanol) | 0 | 0 | 23.0 | 25.0 |
| Aluminum Silicate (−325 mesh) | 0 | 0 | 0 | 50.0 |
| Aluminum Silicate (−20+50 mesh) | 0 | 0 | 0 | 25.0 |
| Stucco | Gadolinium Zirconate −30+100 | $ZrO_2$ −35+80 | $ZrO_2$ −35+80 | Aluminum Silicate −20+50 |

EXAMPLE IV

| | Facing Slurry | 2 | 3 | 4 and Up |
|---|---|---|---|---|
| Diacetatozirconic Acid (22% $ZrO_2$ in water) | 21.5 | 21.5 | 0 | 0 |
| Water | 7.2 | 7.2 | 0 | 0 |
| Denatured Ethanol | 2.6 | 2.6 | 0 | 0 |
| Ammonium Metatungstate Inhibitor | 25.1 | 25.1 | 0 | 0 |
| Yttrium Oxyfluoride (−325 mesh) | 15.4 | 15.4 | 0 | 0 |
| Dysprosium Oxyfluoride (−325 mesh) | 28.2 | 28.2 | 0 | 0 |
| Zirconium Oxide (−325 mesh) | 0 | 0 | 77.0 | 0 |
| Hydrolyzed Tetraethyl-orthosilicate Solution (15% $SiO_2$ in Ethanol | 0 | 0 | 23.0 | 25.0 |
| Aluminum Silicate (−325 mesh) | 0 | 0 | 0 | 50.0 |
| Aluminum Silicate (−20+50 mesh) | 0 | 0 | 0 | 25.0 |

EXAMPLE IV-continued

| | Facing Slurry | 2 | 3 | 4 and Up |
|---|---|---|---|---|
| Stucco | LaOF −80+150 | LaOF −35+80 | $ZrO_2$ −35+80 | Aluminum Silicate −20+50 |

In all of the foregoing examples, the dip slurries were prepared by adding the inhibitor-forming components, if used, and the binder components to the slurry vehicle and agitating them until a solution or uniform dispersion was obtained. The mold material then was added and the mixing continued until a uniform mixture resulted.

A pattern was dipped and stuccoed alternately with the compositions until the finished mold was produced. The pattern then was removed by melting or solvent treatment, after which the mold was baked at from 500° to 650° K. for from 4 to 8 hours to remove low temperature volatiles. Thereafter the mold was cured at 900° to 2500° K. for from 2 to 4 hours. Where an inhibitor-former was included in the face coat slurry, a purging atmosphere of hydrogen was supplied to the curing furnace. This effected the reduction of the inhibitor-forming compound to metallic tungsten or molybdenum, as the case may be. The metal thus formed covered the surfaces of the binder and mold material components of the face coat, thereby forming a barrier capable of inhibiting subsequent reaction of these mold components with molten metallic titanium, zirconium, or other reactive or refractory metals subsequently cast in the mold.

In a manner similar to the foregoing are prepared molds for casting reactive and refractory metals using as constituents of the mold facing portion one or more of the following materials: oxyfluorides of cerium, neodymium, praseodymium and samarium.

It is to be noted particularly that in all cases where such compounds are used in major proportions as constituents of the mold facing portion, a significant economic advantage results. Certain of the oxyfluorides are of relatively low cost. They replace advantageously a material such as powdered tungsten or molybdenum as primary mold components. The latter materials cost several times as much per pound and are of comparatively high density so that a large weight percentage of them is required for a slurry. Thus the use of the metal oxyfluorides not only produces a mold of superior properties; it also produces one of substantially lower cost.

I claim:

1. A mold for casting molten reactive and refractory metals comprising:

a. a facing portion comprising finely divided particles of at least one member of the group consisting of the oxyfluorides of the metals of Group III*a*, and the lanthanide and actinide series of Group III*a*, of the Mendeleevian periodic chart of the atoms, and a binder therefor, b. said oxyfluorides having free energies of formation at 1000° K. of at least 69 kilocalories per gram atom of contained oxygen and fluorine, and c. a backup portion comprising finely divided particles of shell mold back up material and a binder therefor.

2. The mold of claim 1 wherein the facing portion comprises finely divided particles of at least one member of the group consisting of the oxyfluorides of cerium, neodymium, praseodymium, samarium, lanthanum, thorium, scandium, yttrium, and a binder therefor.

3. The mold of claim 2 wherein the facing portion comprises finely divided particles of cerium oxyfluoride, and a binder therefor.

4. The mold of claim 2 wherein the facing portion comprises finely divided particles of neodymium oxyfluoride and a binder therefor.

5. The mold of claim 2 wherein the facing portion comprises finely divided particles of praseodymium oxyfluoride and a binder therefor.

6. The mold of claim 2 wherein the facing portion comprises finely divided particles of lanthanum oxyfluoride and a binder therefor.

7. The mold of claim 2 wherein the facing portion comprises finely divided particles of thorium oxyfluoride and a binder therefor.

8. The shell mold of claim 1 including from 0.1 to 30% by weight of a refractory metal oxide binder for the oxyfluoride particles.

9. The shell mold of claim 1 including from 0.1 to 30% by weight of a refractory metal oxide binder for the oxyfluoride particles, the refractory metal oxide binder comprising an oxide of at least one metal of the class consisting of the Group III and Group IV metals of the Mendeleevian periodic chart, the metallic oxide having a free-energy of formation of 1000° K. greater than 69 kilocalories per gram atom of oxygen in the oxide.

10. The mold of claim 9 wherein the refractory metal oxide binder comprises at least one member of the group consisting of zirconia, thoria, hafnia, yytria and gadolinia.

* * * * *